United States Patent [19]

De Gaspari

[11] Patent Number: 4,712,589

[45] Date of Patent: Dec. 15, 1987

[54] EQUIPMENT FOR THE HANDLING OF SUBSTANCES MADE FLUID BY HEATING, IN PARTICULAR WAX FOR MODELS

[76] Inventor: Giovanni De Gaspari, Via Lago, 2, 20090 Rodano (Milan), Italy

[21] Appl. No.: 830,011

[22] Filed: Feb. 18, 1986

[30] Foreign Application Priority Data

Feb. 20, 1985 [IT] Italy ..... 19581 A/85

[51] Int. Cl.[4] ..... A61C 13/20

[52] U.S. Cl. ..... 141/25; 222/146.5; 433/167

[58] Field of Search ..... 141/2, 7, 8, 11, 18, 141/20.5, 21, 23, 24, 25, 26, 27, 29, 82; 401/1, 2, 3, 5, 6, 13, 137, 138, 192; 433/167, 171, 213; 222/146.2, 146.5

[56] References Cited

U.S. PATENT DOCUMENTS

| | | | |
|---|---|---|---|
| 897,782 | 9/1908 | Reilley | 141/82 X |
| 2,994,349 | 8/1961 | Demos | 141/21 |
| 3,406,875 | 10/1968 | Park | 141/24 X |
| 3,665,158 | 5/1972 | Froedge | 141/82 X |
| 3,882,909 | 5/1975 | Ogle | 141/286 |
| 3,963,061 | 6/1976 | Kenney | 141/21 |
| 4,176,693 | 12/1979 | Stoner et al. | 141/82 X |
| 4,360,046 | 11/1982 | Streit et al. | 141/82 |
| 4,485,831 | 12/1984 | Ungerleider | 141/82 X |

*Primary Examiner*—Mark John Thronson

*Attorney, Agent, or Firm*—Diller, Ramik & Wight

[57] ABSTRACT

An apparatus for handling substances which are rendered fluid by heating, such as wax, the apparatus including a body defining a chamber having opposite walls and a filter therebetween separating the chamber into a liquid chamber and an air chamber, openings for introducing air into and withdrawing air from the air chamber, openings for drawing liquid into and ejecting liquid from the liquid chamber in response to the respective withdrawal and introduction of air into the air chamber, a resistor in the liquid chamber for maintaining substances therein liquid, the resistor being housed in a tube extending between the walls and through the filter having at least one bore for placing the tube in fluid communication with the liquid chamber, a hand piece, a duct in the hand piece, and a part of the resistor and a short tubular element maintaining the body and hand piece in coupled but readily decoupled relationship.

11 Claims, 3 Drawing Figures

EQUIPMENT FOR THE HANDLING OF SUBSTANCES MADE FLUID BY HEATING, IN PARTICULAR WAX FOR MODELS

BACKGROUND OF THE INVENTION

The present invention relates to apparatus, equipment or a machine for handling substances, such as wax, which are rendered fluid by heating and can be specifically used for making wax models.

It is known to use rigid tools for handling wax or similar substances. Such conventional tools can collect a drop or a slightly greater amount of the liquid substances, and position the same upon an element for subsequent working/shaping before the substances, again such as wax, returns to its original solid state as it cools.

In the orthodontic field wax is used for forming models, cores, and/or impressions suitable for the construction of prostheses or parts of teeth.

In the orthondontic field a tool is heated at one of its ends, and when well heated, the tool is used to draw a small amount of wax from a solid block thereof. This small amount of wax is made fluid by the hot end of the tool and, thus, the heated wax can be positioned as desired and can be subsequently shaped.

In accordance with another conventional alternative method/ apparatus, wax can be directly heated and made fluid in a crucible from which it is withdrawn by means of a tool in dropwise fashion, and while still fluid the wax is cast, shaped and/or formed.

Such conventional apparatuses and associated methods involve the continuous transfer of substances in very small amounts with attendant inefficiencies and waste of time. Accordingly, these conventional apparatuses necessarily require "rough" casting, forming and/or shaping steps, followed by subesquent "finishing" steps inherently creating increased time and waste of material.

In another conventional apparatus involving tin solder, a rod or a continuous wire with solder material is used in combination with the hot tip of a tool. In such apparatus, the substance which is continuously melted is applied to a substrate and shaped as needed. The solder or like material is drawn from a source, transferred to the substrate, and there is no ability in such apparatus of increasing or decreasing the amount handled. A major disadvantage of apparatuses of this type is the necessity of relying upon an operator's expertise in assuring a quality product.

SUMMARY OF THE INVENTION

The present invention avoids the latter-noted problems of conventional equipment by providing an apparatus having a certain degree of autonomy, yet allowing precise treatment and handling of relevant amounts of substances, such as wax, which are rendered fluid by heating.

In accordance with the present invention, the apparatus includes a tool having a tank connected to a hand piece. The tank defines an interior liquid chamber and air chamber separated by a filter, a nozzle for drawing liquid into the tank and ejecting liquid therefrom, an air duct for selectively connecting positive and negative air to the air duct for respectively ejecting and drawing liquid from the liquid chamber of the tank which during the ejection stage is used to form an appropriate model, casting, impression or the like.

The structural and functional characteristics and the advantages of apparatus according to the present invention shall be better understood from the following exemplary disclosure referred to the attached drawings wherein:

DESCRIPTION OF THE PREFERRED EMBODIMENTS

Figure 1:
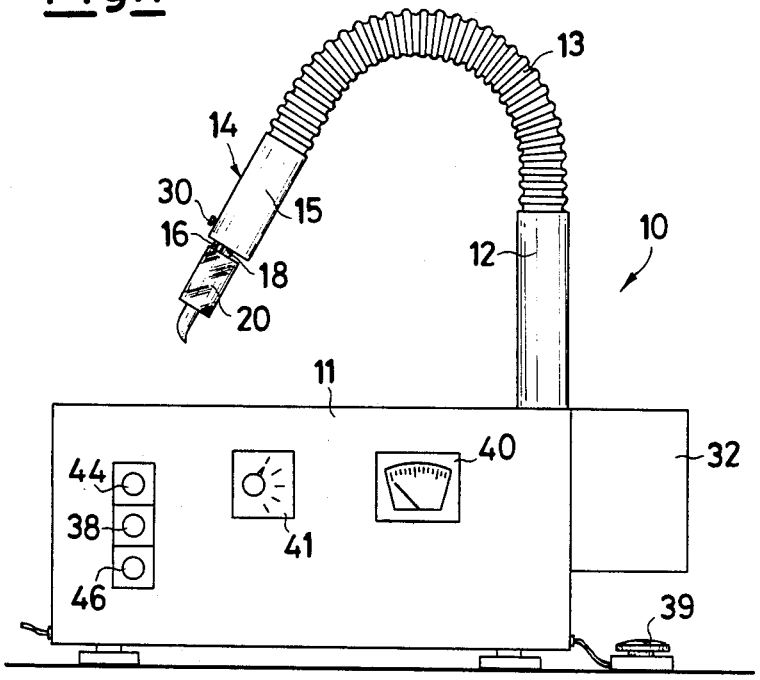
FIG. 1 is a side elevational view of an apparatus, equipment or machine constructed in accordance with the present invention, and illustrates a hand piece carrying a tank having a nozzle for drawing liquid therein or ejecting liquid therefrom.
Figure 2:
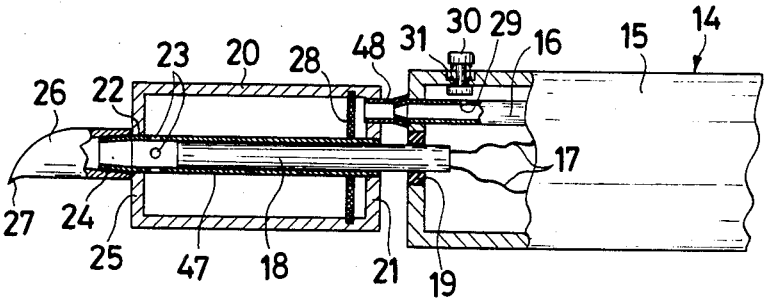
FIG. 2 is an enlarged fragmentary sectional view of the nozzle, tank and hand piece, and illustrates a filter and a resistance heater in the tank and an air duct controlled by a push-button for regulating the introduction and ejection of liquid relative to the liquid chamber of the tank.

Reference is first made to FIGS. 1 and 2 of the drawings in which a machine, apparatus or equipment according to the present invention is generally designated by the reference numeral 10. The apparatus 10 includes a box-like element or housing 11 which contains much of the components of the electrical circuit of FIG. 3, a pump 34, a regulating circuit 42 and an air valve 33. The handling element or hand piece 14 is connected to the housing 11 by a flexible portion or hose 13 and a tubular connecting element 12. A crucible, housing or tank 32 serves as a source of supply for a solid substance, such as wax, which can be rendered liquid when heated by, for example, the resistor 45 (FIG. 3) associated with a tank or crucible 32.

Figure 3:
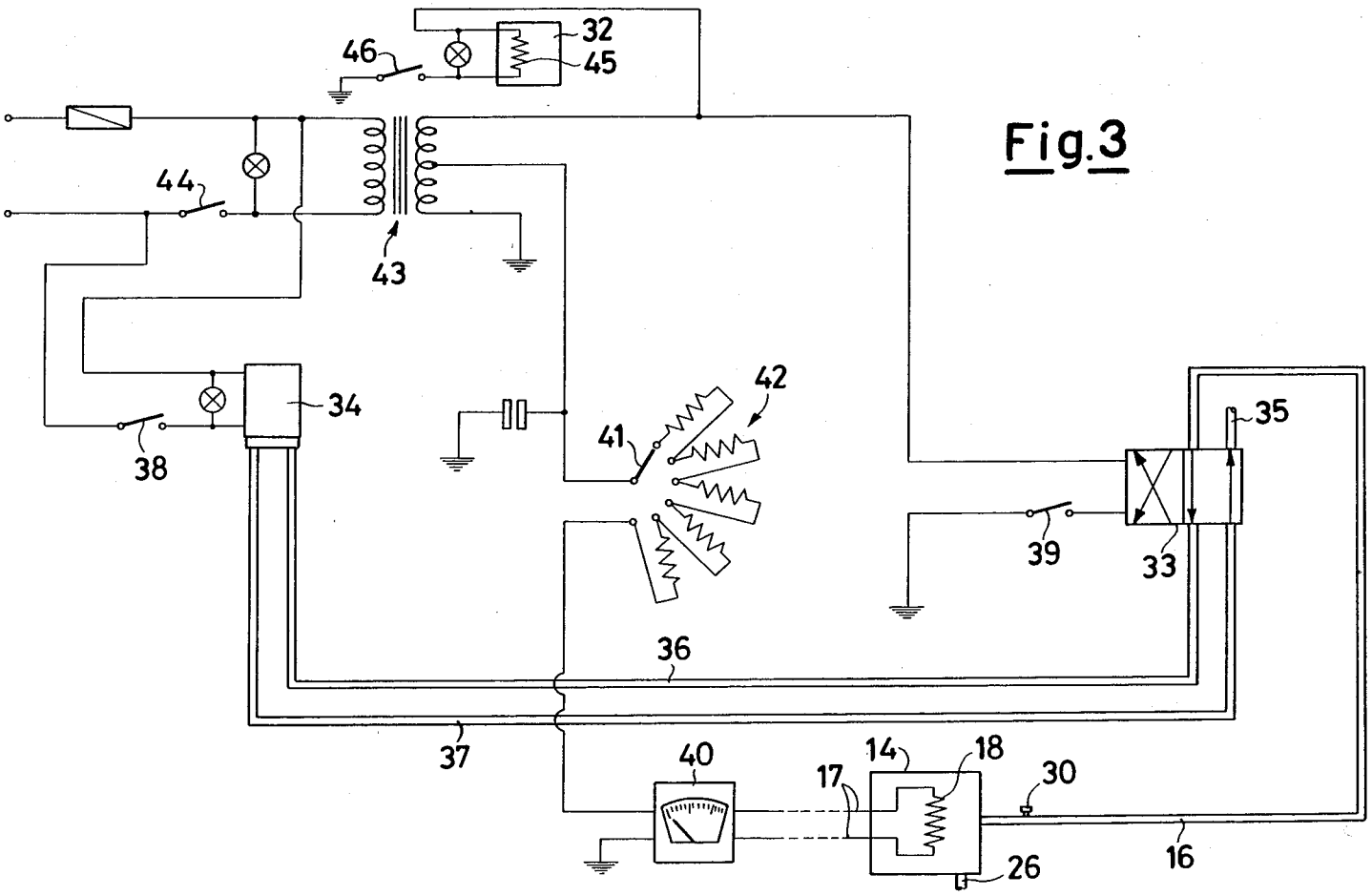
FIG. 3 is a schematic view of an electrical circuit for the apparatus, and illustrates a switch for regulating the introduction of air into and/or withdraw from the air chamber of the tank, the tank resistor, and a resistor for a crucible defining a source from which the wax can be withdrawn.

The hand piece 14 includes a handgrip body 15 which is hollow (FIG. 2) and houses a duct 16 which is connected through the valve 33 (FIG. 3) over a line or duct 36 to a pump 34 (FIG. 3). Electrical conductor 17 is also housed in the hand piece 14 and specifically the body 15 thereof, and these are connected between a candle-resistor, heating element or heating means 18. The resistor 18 has an end (unnumbered) with which is received in a heat insulating sleeve 19 and projects through an end wall or base 21 of a cylindrical tank or body 20 removably connected to or carried by the hand piece 14. A tube or tubular support 47 spans the chamber (unnumbered) of the body or tank 20 and includes one end (unnumbered) received in an opening (unnumbered) of the base or wall 21 and another end 22 received in an opening of an opposite base or wall 25. The tube 47 has a plurality of radial bores 23 which place a nozzle 26 having a tip 27 in fluid communication with a wax or liquid chamber to the left (as viewed in FIG. 2) of a filter or filtering element 28. A frusto-conical end portion 24 of the tube 47 snugly receives the nozzle 26 and permits the latter to be rapidly removed and replaced therefrom. The end 27 of the nozzle 27 is closed but can be cut or snipped-off or simply provided with a small opening. The filter 28 is of such porosity that liquid will not pass therethrough whereas air relatively freely passes therethrough from an air chamber (unnumbered) between the filter 28 and the base or wall 21. The air chamber is connected by a short tube 48 to a tapered end of the duct 16 (FIG. 2). An opening 29 is provided in the duct 16 in opposition to a small push-button 30 which is normally lifted to its rest position by an elastic element 31. The slidable connection between the tubular element 47 and the exposed end of the duct 16, as well as the slidable connection between the resistor 18 and the tube 47, constitutes removable connecting means for rapidly connecting and disconnecting the tank 20 relative to the hand piece 14. Furthermore, the tank 20 is preferably constructed from transparent material so that the substance (wax) therein can be readily observed.

Reference is made to FIG. 3 which illustrates the duct 16 being connected to the valve or electrovalve 33. The valve 33 has two positions in the one of which illustrated in FIG. 3 shows the air from a pump 34 being delivered to atmosphere through a discharge duct 35. The pump or pumping means 34 is operated through a switch 38 which, when closed, will, depending upon the position of the valve 33, deliver positive pressure through the duct 16 (FIG. 2) into the air chamber of the body 20 and through the filter 28 to force the liquid substance (wax) within the liquid chamber to flow through the bores 23 and the nozzle 26 until ejected from the orifice or opening 27. The flow of air is, of course, regulated by the push-button 30. When the switch 30 is positioned in its second position, negative air pressure is drawn from the air chamber through the short tube 47 and the duct 16 which places negative pressure upon the liquid chamber. The latter is utilized when the nozzle 27 is immersed in the source of substance or wax within the crucible 32 which will draw the liquid substance into the liquid chamber until filled with, of course, the latter also being controlled by the position of the push-button 30. Accordingly, depending upon the direction of flow of the air as determined by the position of the electrovalve 33, the liquid substance/wax would be drawn into the liquid chamber of the tank or body 20 or ejected therefrom. In this manner a liquid substance is not only drawn into the tank or body 20 but is maintained liquid therein by the heating element/resistor 18, yet can be selectively ejected through the nozzle 26.

Reference is now specifically made to FIG. 3 and the various other components of the electric circuit thereof including a switch 39 which is simply closed to provide power to the electrovalve 33 from an associated transformer 43. A variable resistor 42 of this circuit can also be selectively varied by moving an arm 41 manually to alter the current flowing to the resistor 18 in the liquid chamber of the tank 20 thereby selectively regulating the viscosity of the substance/wax therein. An appropriate instrument 40 provides a read-out of the status of the registor 18. The entire circuit is, of course, rendered operational by closing a switch 44 while a switch 46, when closed, energizes the resistor 45 of the crucible or tank 32.

Once the crucible or tank 32 has been filled with wax, the switches 46, 44, 38 and 39 are closed to energize the resistors 45, 42, 18, the pump 34, and the electrovalve 33. The arm 41 of the switch 42 can be positioned, as desired, to control the current flow through the resistor 18 and, thus, the heat generated therby.

As heretofore noted, with the switch 33 in a position shown in FIG. 3, negative pressure or suction will operate to draw air through the orifice 27, the nozzle 26, the tube 47, the bores 23, etc. Obviously, when the tip 26 is immersed in the liquid substance/wax within the crucible or tank 32 the substance will be drawn into the liquid chamber of the tank or body 20 and will remain fluid because of the heat generated by the resistor 18 therein. Obviously, the filter 28 prevents the liquid from passing into the air chamber to the right of the filter 28 in FIG. 2.

When the tank or body 20 has been filled, this is known because of the transparency thereof, and the operator can now transfer drop-wise the wax from the orifice 27 by simply displacing the electrovalve 33 to its second position causing positive air pressure to be introduced by the duct 16 into the air chamber to the right of the filter 28 and obviously therethrough against the liquid in the liquid chamber of the body 20. The force of the positive air pressure is, of course, regulated by the operation of the push button heretofore noted, and thus the liquid can be discharged from the orifice 27 of the nozzle 26 in a highly controlled fashion, be it drop-wise or in a stream. Obviously, the substance/wax can be discharged until the tank 20 has been emptied and this is apparent through the transparent wall thereof. The reading on the instrument 20 can also be utilized for operational purposes to increase or decrease the fluidity/consistency of the material in the liquid chamber dependent upon the heat generated by the resistor 18.

Although a preferred embodiment of the invention has been specifically illustrated and described herein, it is to be understood that minor variations may be made in the apparatus without departing from the spirit and scope of the invention, as defined in the appended claims.

I claim:

1. Apparatus for handling a liquid through the selective utilization of negative and positive air pressure comprising a body defining a chamber, filter means for separating said chamber into a liquid chamber and an air chamber, said filter means further precluding the passing of liquid therethrough, means for introducing air into and withdrawing air from said air chamber, means for drawing liquid into and ejecting liquid from said liquid chamber in response to the respective withdrawal and introducing of air into said air chamber, means for heating the liquid while in the liquid chamber, a tube within at least said liquid chamber in fluid communication with said liquid drawing and ejecting means, and at least one bore in said tube placing said tube in fluid communication with said liquid chamber.

2. The apparatus as defined in claim 1 wherein said heating means is at least partially housed within said tube.

3. The apparatus as defined in claim 2 wherein said body includes opposite walls in part accommodating said respective air introducing and withdrawing means and said liquid drawing and ejecting means.

4. The apparatus as defined in claim 2 wherein said body includes opposite walls in part accommodating said respective air introducing and withdrawing means and said liquid drawing and ejecting means, and said filter means being disposed between said opposite walls.

5. The apparatus as defined in claim 2 wherein said body includes opposite walls in part accommodating said respective air introducing and withdrawing means and said liquid drawing and ejecting means and said tube spans said opposite walls.

6. The apparatus as defined in claim 2 wherein said body includes opposite walls in part accommodating said respective air introducing and withdrawing means and said liquid drawing and ejecting means, said tube spans said opposite walls, and said heating means is slidably introduced into said tube from the exterior of one of said opposite walls.

7. The apparatus as defined in claim 2 including a hand piece, means for removably coupling said body to said hand piece, and said removable coupling means being defined in part by a tubular element between said hand piece and said air introducing and withdrawing means.

8. The apparatus as defined in claim 2 including a hand piece, means for removably coupling said body to said hand piece, and said removable coupling means being defined in part by a projecting end of said heating means connected to said hand piece.

9. The apparatus as defined in claim 2 including a hand piece, means for removably coupling said body to said hand piece, and said removable coupling means being defined in part by a projecting end of said heating means slidably connected to said hand piece.

10. The apparatus as defined in claim 2 including a hand piece, means for removably coupling said body to said hand piece, and said removable coupling means being defined in part by a projecting end of said heating means connected to said hand piece and by a projecting end of said heating means connected to said hand piece.

11. Apparatus for handling a liquid through the selective utilization of negative and positive air pressure comprising a body defining a chamber, filter means for separating said chamber into a liquid chamber and an air chamber, said filter means further precluding the passing of liquid therethrough, means for introducing air into and withdrawing air from said air chamber, means for drawing liquid into and ejecting liquid from said liquid chamber in response to the respective withdrawal and introducing of air into said air chamber, means for heating the liquid while in the liquid chamber, a hand piece, a duct in said hand piece connected to said air introducing and withdrawing means, means for selectively regulating the passage of air through said duct, and a tubular element connecting said duct to said air introducing and withdrawing means.

* * * * *